US006520810B1

(12) United States Patent
LePottier et al.

(10) Patent No.: US 6,520,810 B1
(45) Date of Patent: Feb. 18, 2003

(54) CONNECTOR SYSTEM FOR INTERCONNECTION WITH FLAT FLEXIBLE CIRCUITRY

(75) Inventors: Yves LePottier, Grosse Pointe; Robert M. Fuerst, West Bloomfield, both of MI (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/003,541

(22) Filed: Oct. 24, 2001

(51) Int. Cl.[7] ..... H01R 13/502
(52) U.S. Cl. ..... 439/701; 439/540.1; 439/637
(58) Field of Search ..... 439/709, 701, 439/540.1, 492, 494, 495, 660, 496, 499, 637, 636, 291

(56) References Cited

U.S. PATENT DOCUMENTS 3,086,188 A * 4/1963 Ross ..... 439/291
3,325,769 A * 6/1967 Travis ..... 439/496
4,206,958 A * 6/1980 Hall et al. ..... 174/90
4,665,614 A * 5/1987 Stipanuk et al. ..... 29/566.2
4,915,641 A * 4/1990 Miskin et al. ..... 439/247
4,997,386 A * 3/1991 Kawachi et al. ..... 439/352
5,660,556 A * 8/1997 Badaroux et al. ..... 418/133
6,113,415 A * 9/2000 Bertsch et al. ..... 439/353
6,183,299 B1 * 2/2001 Ward et al. ..... 439/595

* cited by examiner

*Primary Examiner*—Tho D. Ta
*Assistant Examiner*—Edwin A. Léon
(74) *Attorney, Agent, or Firm*—Stacey E. Caldwell

(57) ABSTRACT

A connector assembly for interconnection to conductors of a flat circuit, wherein the conductors are in a pattern of varying widths. A dielectric housing has a receptacle with an opening communicating the receptacle to the exterior of the housing. A plurality of terminal blocks of conductive material are positionable in the receptacle. The terminal blocks have varying sizes with corresponding varying planar surfaces exposed at the opening in the housing for engaging the conductors of the flat circuit. The blocks are arranged in the receptacle so that they present a pattern of varying sized planar surfaces matching the pattern of varying width conductors.

21 Claims, 5 Drawing Sheets

CONNECTOR SYSTEM FOR INTERCONNECTION WITH FLAT FLEXIBLE CIRCUITRY

FIELD OF THE INVENTION

This invention generally relates to the art of electrical connectors and, particularly, to a connector assembly for interconnection to conductors of a flat circuit such as a flat flexible circuit. The invention is particularly applicable in a system for connecting a plurality of discrete electrical wires to the conductors of a flat circuit, wherein the conductors have varying widths.

BACKGROUND OF THE INVENTION

A flat flexible circuit conventionally includes an elongated flat flexible dielectrical substrate having laterally spaced strips of conductors on one or both sides thereof. The conductors may be covered with a thin, flexible protective coating on one or both sides of the circuit. If protective layers are used, openings are formed therein to expose the underlying conductors at desired contact locations where the conductors are to engage the conductors of a complementary mating connecting device which may be a second flat flexible circuit, a printed circuit board or the discrete terminals of a mating connector which may be terminated to discrete electrical wires.

A wide variety of connectors have been designed over the years for terminating flat flexible circuits or for interconnecting flat flexible circuits with the conductors of complementary mating connecting devices. However, problems still are encountered with such connectors when the flat circuitry has conductor strips of varying widths for providing varying current characteristics on a single flat circuit. In other words, as stated above, the flat circuit has laterally spaced strips of conductors on an elongated flat dielectric substrate, but the conductors in many applications may not be of constant widths. For instance, in an automotive application, a single flat flexible circuit may have conductors of varying widths to provide varying current capacities for various functions throughout the automobile. A narrow conductor strip may simply carry sensor signals or logic signals, for example. A wide conductor strip may carry power to lights, power window motors or the like. Obviously, the conductor strips of the flat circuitry must be connected to different or varying conductors of a complementary mating connecting devices, such as discrete electrical wires of different sizes or gages. The present invention is directed to solving these problems and providing an extremely simple modular system or connector assembly for interconnection to different sized conductors of flat circuitry.

SUMMARY OF THE INVENTION

An object, therefore, of the invention is to provide a new and improved connector assembly for interconnection to the conductors of a flat circuit, such as a flat flexible circuit, wherein the conductors are in a pattern of varying widths.

Another object of the invention is to provide a system for connecting a plurality of discrete electrical wires to the conductors of a flat circuit, the conductors again having varying widths in a pattern laterally of the flat circuit.

In the exemplary embodiment of the invention, a dielectric connector housing has a receptacle with an opening communicating the receptacle to the exterior of the housing. A plurality of terminal blocks of conductive material are positionable in the receptacle. The terminal blocks having varying sizes with corresponding varying planar surfaces exposed at the opening to the receptacle for engaging the conductors of the flat circuit. The blocks are arranged in the receptacle so that they present a pattern of varying sized planar surfaces matching the pattern of varying width conductors.

The invention is disclosed herein as particularly applicable for connecting a plurality of discrete electrical wires to the varying width conductors of the flat circuit. To that end, termination means are provided on the terminal blocks for terminating a plurality of electrical wires thereto. The termination means are provided by holes in the terminal blocks for insertion of the electrical wires thereinto. The holes in the terminal blocks are variably sized in direct proportion to the varying sizes of the terminal blocks. The terminal blocks are shown generally rectangular in cross-section and are fabricated of metal material. The blocks can be deformed to clamp the wires in the holes of the blocks. Retaining means are provided on the connector housing to hold the terminal blocks in the receptacle of the housing.

The invention contemplates that the terminal blocks can be mounted in the receptacle of the housing in a close side-by-side array. Therefore, a dielectric separator is provided between each adjacent pair of terminal blocks in the receptacle.

According to one aspect or embodiment of the invention, the dielectric separator is fixed to at least one of the terminal blocks in each adjacent pair thereof. The dielectric separator may be formed by a flat wafer fixed to a planar side surface of the at least one terminal block.

According to another aspect or embodiment of the invention, the dielectric separator is on the dielectric connector housing. Preferably, the separator comprises a wall molded integrally with the connector housing. In the preferred embodiment, a plurality of the separator walls are disposed at regular intervals along the receptacle. The walls are severable from the housing to accommodate terminal blocks of varying sizes in varying arrays between the walls.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
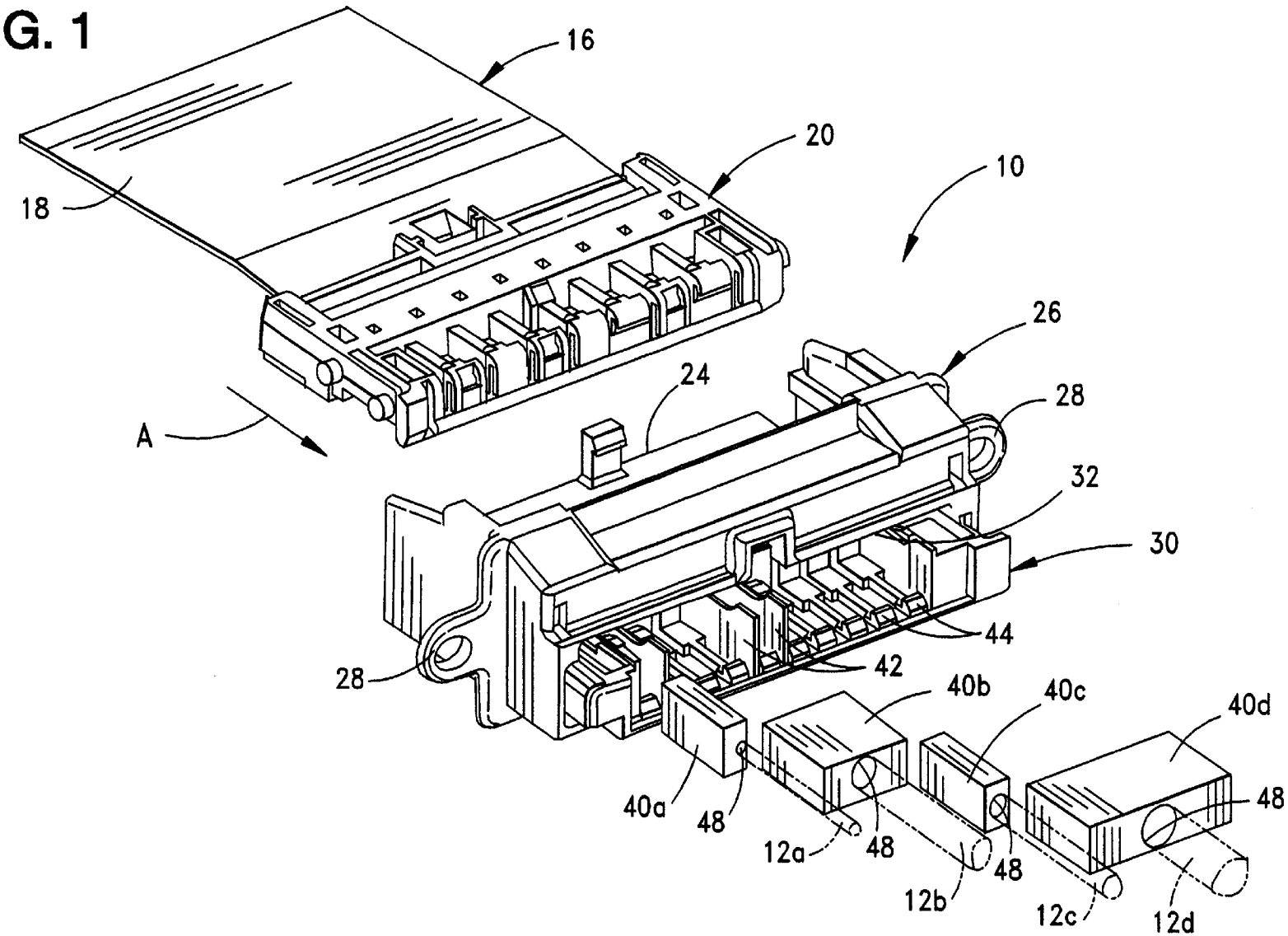
FIG. 1 is an exploded top perspective view of a connector assembly incorporating one embodiment of the invention.
Figure 2:
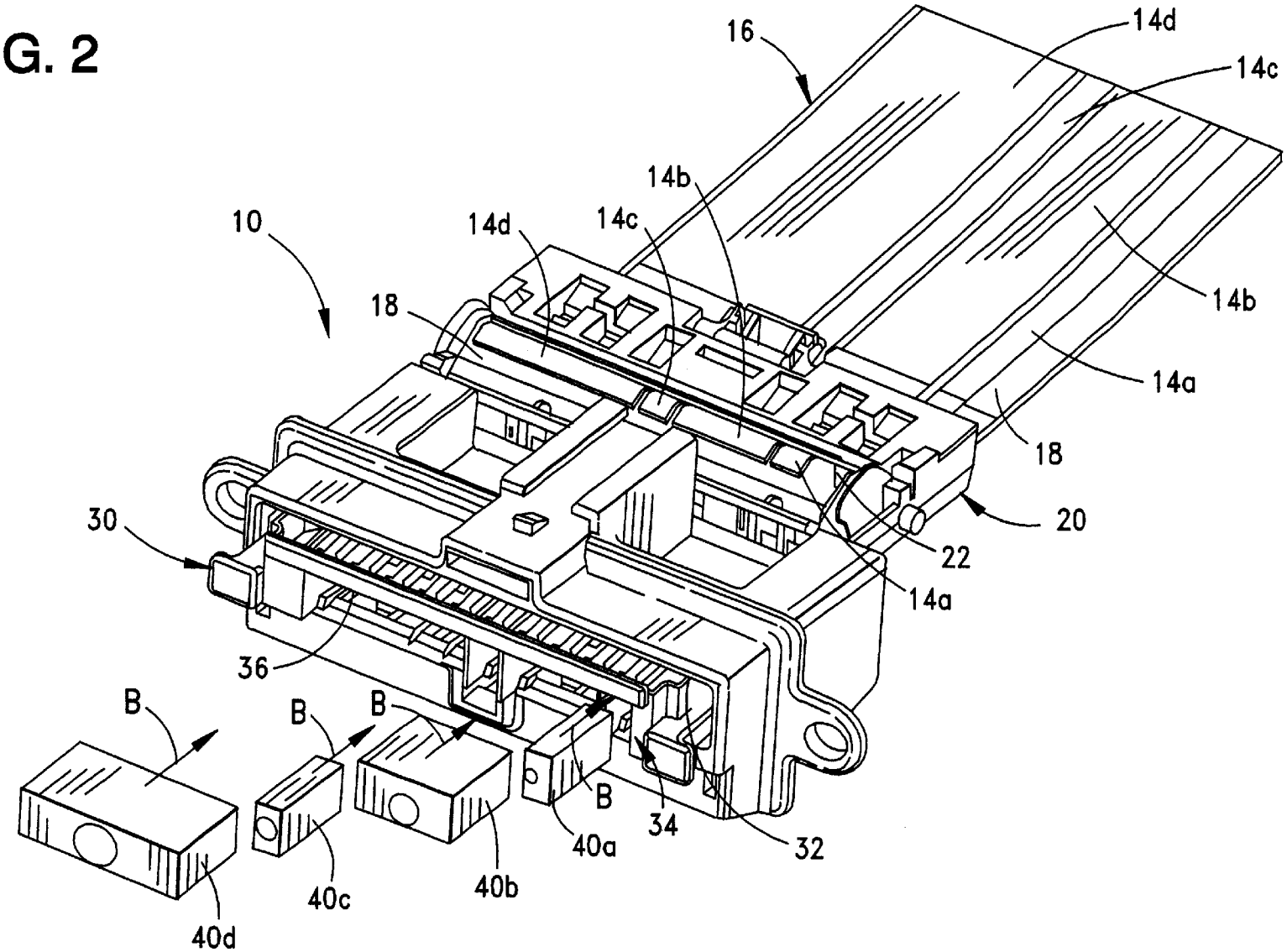
FIG. 2 is an exploded bottom perspective view of the assembly of FIG. 1.

Referring to the drawings in greater detail, and first to FIGS. 1 and 2, the invention is embodied in a system, generally designated 10, for connecting a plurality of discrete electrical wires shown in phantom at 12*a*–12*d* in FIG. 1 to the conductors 14*a*–14*d* (FIG. 2) of a flat circuit such as a flat flexible circuit, generally designated 16. As stated in the "Background", above, flat flexible circuit 16 has a flat flexible dielectric substrate 18 (FIG. 1) onto which flat flexible strips of conductors 14*a*–14*d* are disposed. Flat flexible circuit 16 is terminated in a complementary mating connector, generally designated 20, which may take a wide variety of configurations or designs. Suffice it to say, conductors 14*a*–14*d* are exposed on a convex contact area, generally designated 22, as seen clearly in FIG. 2.

Complementary mating connector 20 is inserted in the direction of arrow "A" (FIG. 1) into a top rear receptacle 24 of an adapter, generally designated 26. Like connector 20, adapter 26 can take a wide variety of configurations. In the illustrated configuration, the adapter is designed for positioning within a hole in a supporting panel, and a pair of islets 28 project outwardly from opposite sides of the adapter for securing the adapter to the panel. The invention is embodied primarily in a connector assembly, generally designated 30, which is insertable into a bottom front receptacle 32 of the adapter. Repeating, adapter 26 and mating connector 20 are but one illustrative embodiment of an application or use of the novel connector assemblies incorporating the invention herein.

Figure 3:
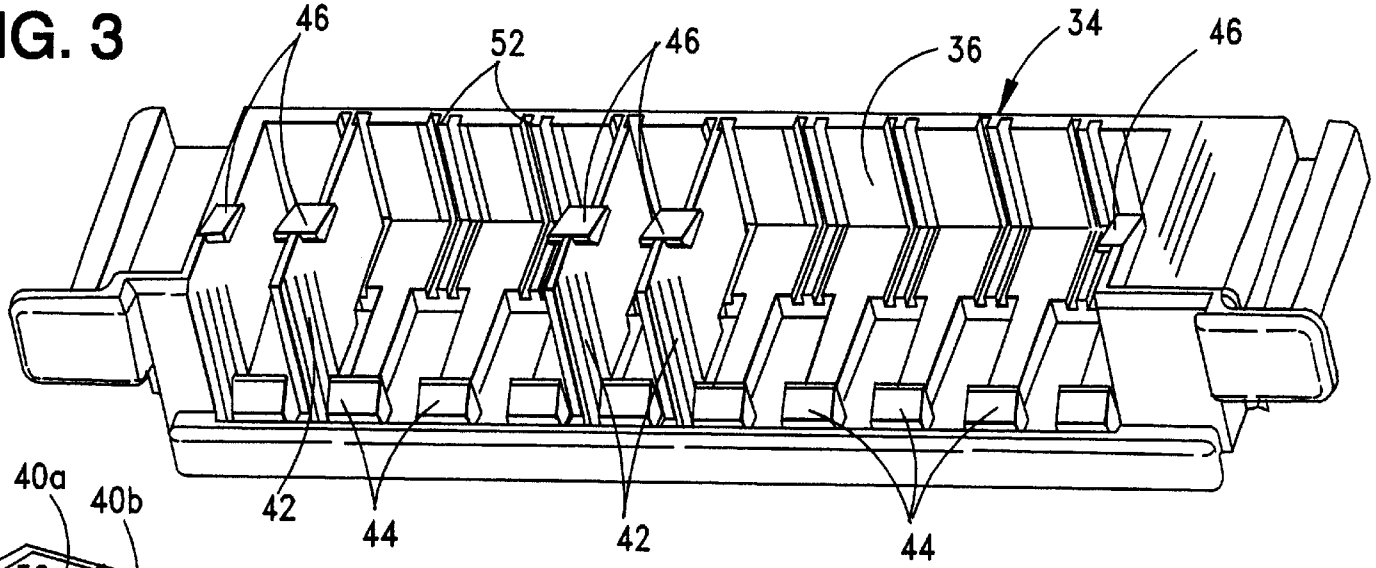
FIG. 3 is a perspective view of the dielectric connector housing for receiving the terminal blocks in the embodiment of FIGS. 1 and 2.
Figure 4:
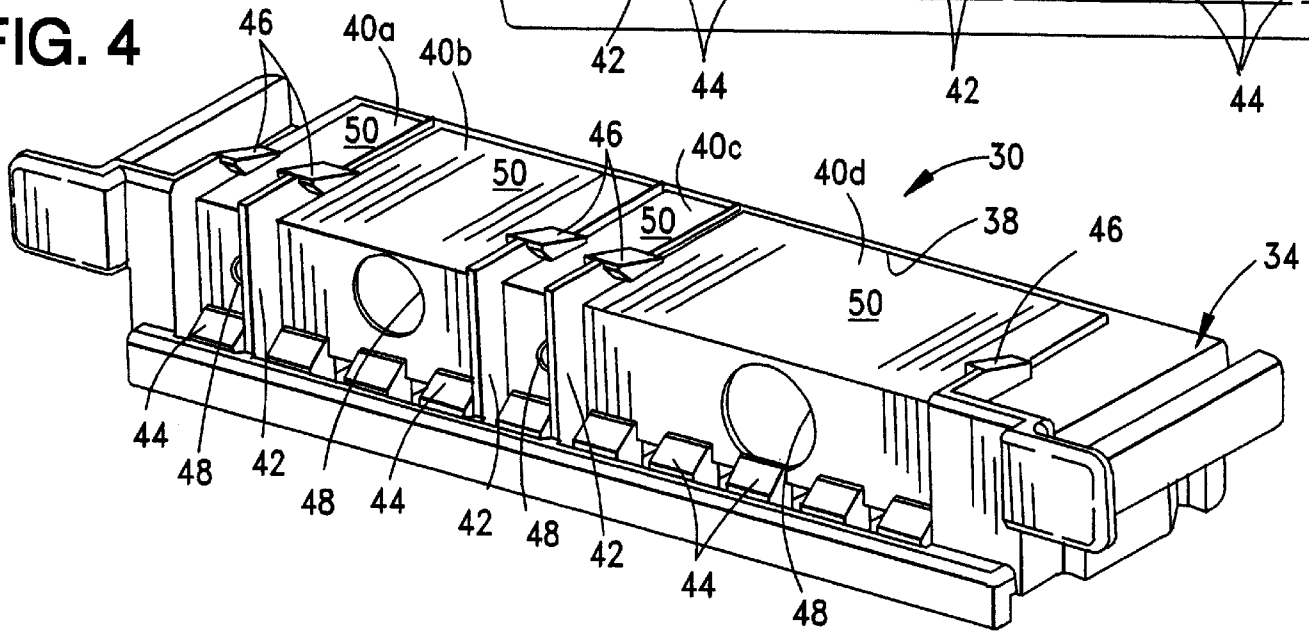
FIG. 4 is a perspective view of the housing of FIG. 3, with the terminal blocks mounted therein.

More particularly, referring to FIGS. 3 and 4 in conjunction with FIGS. 1 and 2, connector assembly 30 includes a dielectric connector housing, generally designated 34 and shown isolated in FIG. 3. The housing has a receptacle 36 (FIG. 3) which is open, as at 38 (FIG. 4), to communicate the receptacle with the exterior of the housing. The housing mounts a plurality of terminal blocks 40*a*–40*d*. Housing 34 is a one-piece structure unitarily molded of dielectric material such as plastic or the like. The housing has dielectric separator walls 42 which electrically separate or isolate adjacent terminal blocks 40*a*–40*d* from each other. The terminal blocks are snapped into receptacle 36 past ramped retaining bosses 44 along the bottom front edge of the receptacle, and the terminal blocks are held in the receptacle by top retaining flanges 46 molded integrally with separator walls 44 and at each opposite end of the receptacle.

Each terminal block 40*a*–40*d* is generally rectangular in cross-section and is fabricated of solid metal material. For instance, the terminal blocks may be fabricated of solid brass plated with tin. The blocks have holes 48 for insertion thereinto of electrical wires 12*a*–12*d* (FIG. 1). The metal blocks can be deformed to clamp onto the wires. The wires are of different sizes or gages preferably in direct proportion to the sizes of the terminal blocks. When the terminal blocks are mounted in housing 34, flat or planar surfaces 50 of the terminal blocks are exposed through opening 38 (FIG. 4) of receptacle 36 (FIG. 3). In other words, as seen in FIG. 4, flat or planar surfaces 50 of the terminal blocks are exposed rearwardly of retaining flanges 46 at opening 38 of the housing receptacle.

At this point, reference is made back to FIG. 2 wherein it can be seen that the strips of conductors 14*a*–14*d* on flat flexible circuit 16 have varying widths in a pattern laterally of the flat circuit. This pattern of varying width conductors can vary considerably depending upon the performance specification of a given circuit. For instance, as pointed out in the automotive application in the "Background", above, narrow strips of conductors 14*a* and 14*c* may simply carry sensor signals or logic signals to various components of an automobile. Wider conductors 14*b* and 14*d* may carry power to such components as lights, power window motors, or the like. With this pattern of varying width conductors shown in FIG. 2, it also can be seen in FIG. 2 that terminal blocks 40*a*–40*d* are arranged for insertion into receptacle 36 of housing 34 of connector 30 in the direction of arrows "B", and in an array of sizes corresponding to the widths of circuit conductors 14*a*–14*d*. In other words, smaller terminal block 40*a* is sized to match narrow circuit conductor 14*a*; larger terminal block 40*b* is sized to match wider circuit conductor 14*b*; smaller terminal block 40*c* is sized to match narrow circuit conductor 14*c*; and the largest terminal block 40*d* is sized to match the widest circuit conductor 40*d*.

With the above understanding of matching the sizes and array of terminal blocks 40*a*–40*d* with the sizes and array of circuit conductors 14*a*–14*d*, reference now is made to FIG. 4 where it can be seen that planar surfaces 50 again are exposed at opening 38 at the rear of housing 34. In essence, terminal blocks 40*a*–40*d* are arranged in the receptacle of housing 34 so that they present a pattern of varying sized planar surfaces 50 matching the pattern of varying width conductors 14*a*–14*d* as described above. When connector assembly 30 is inserted into bottom front receptacle 32 (FIG. 1) of adapter 26, and mating connector 20 is inserted into top rear receptacle 24 of the adapter, conductors 14*a*–14*d* exposed on convex contact area 22 (FIG. 2) will engage planar surfaces 50 (FIG. 4) of the terminal blocks inwardly of retaining flanges 46.

Figure 5:
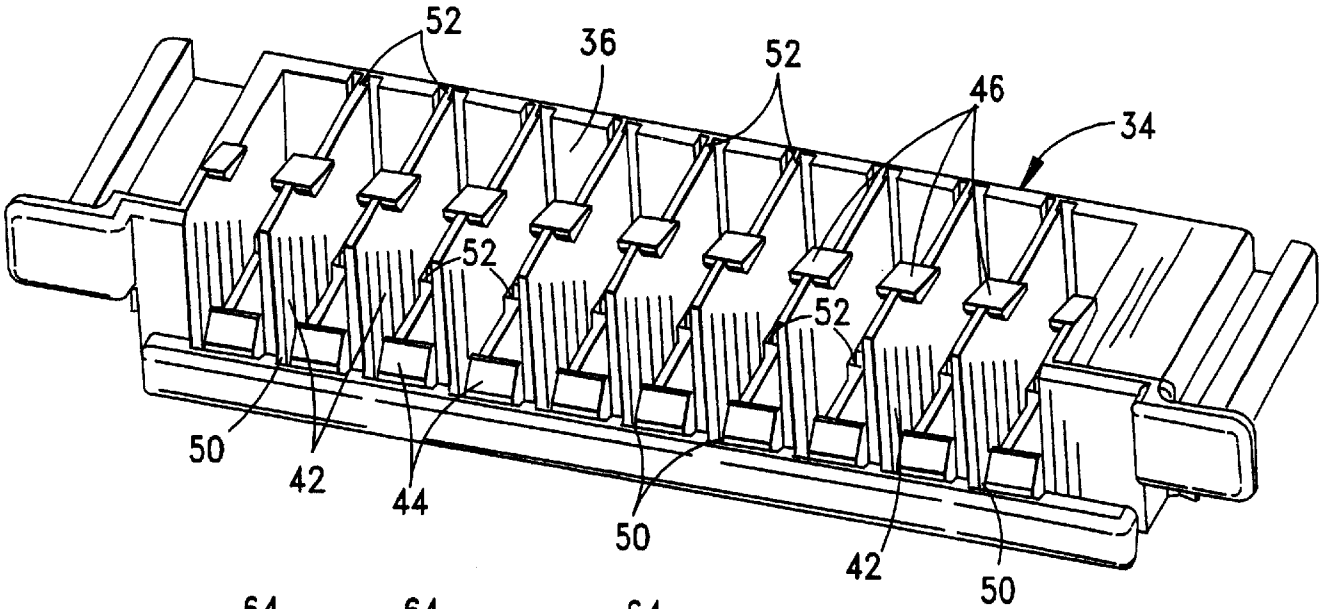
FIG. 5 is a perspective view of the housing of FIG. 3, before the separator walls have been broken away to accommodate the different sizes of terminal blocks shown in FIG. 4.

FIG. 5 shows a unique construction of housing 34 whereby a common or universal housing can be molded and then customized for accommodating terminal blocks of varying sizes in varying arrays between dielectric separator walls 42. Specifically, as stated above, housing 34 is molded of dielectric material such as plastic or the like, and separator walls 42 are molded integrally therewith. However, it should be noted in FIG. 5 that the separator walls are connected to the remainder of the housing by small frangible webs 50 at the front bottom corners of the walls. In addition, the rear edges and parts of the bottom edges of the walls are connected to the housing by thin or narrow frangible sections 52. In FIG. 5, it can be seen that separator walls 42 are disposed at regular intervals along receptacle 36 of housing 34. However, in comparing FIG. 5 with FIG. 3, it can be seen that quite a number of the separator walls have been removed to provide different spacings therebetween to accommodate the array of differently sized terminal modules 40*a*–40*d* shown in FIG. 4. This customization of housing 34 is achieved simply by breaking-away separator walls 42 from the remainder of the housing, and this is easily facilitated by frangible webs 50 and frangible sections 52. The separator walls simply are broken away at frangible webs 50 and frangible sections 52 by an appropriate tool, such as a common pliers or the like, and housing 34 can be customized to accommodate terminal blocks of varying sizes in considerably varying arrays between the separator walls which selectively remain in place.

Figure 6:
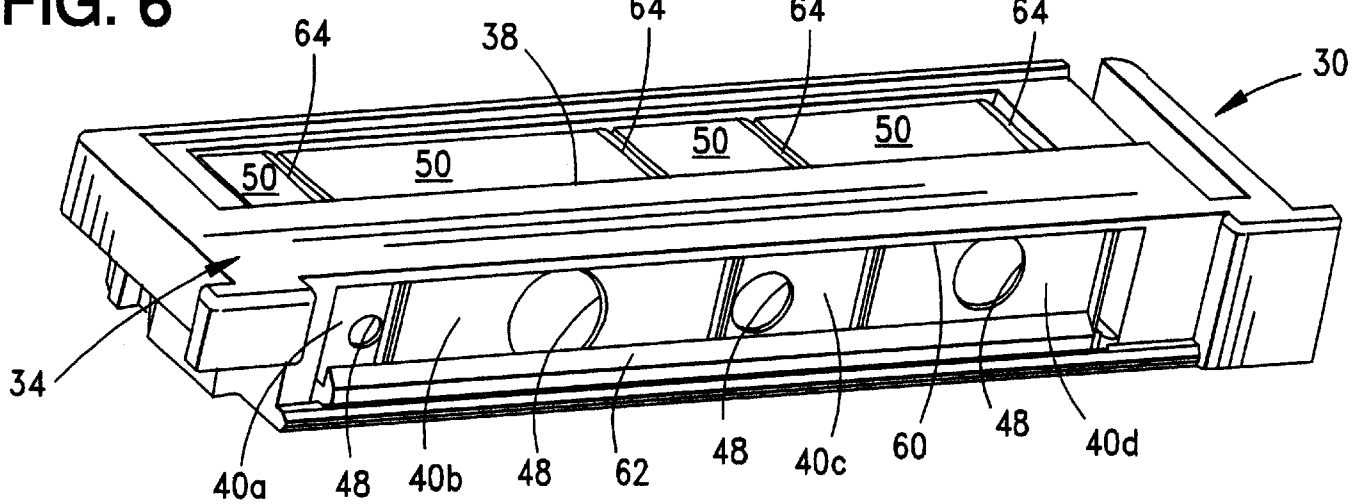
FIG. 6 is a perspective view of a second embodiment of a connector housing and terminal blocks according to the invention.
Figure 7:
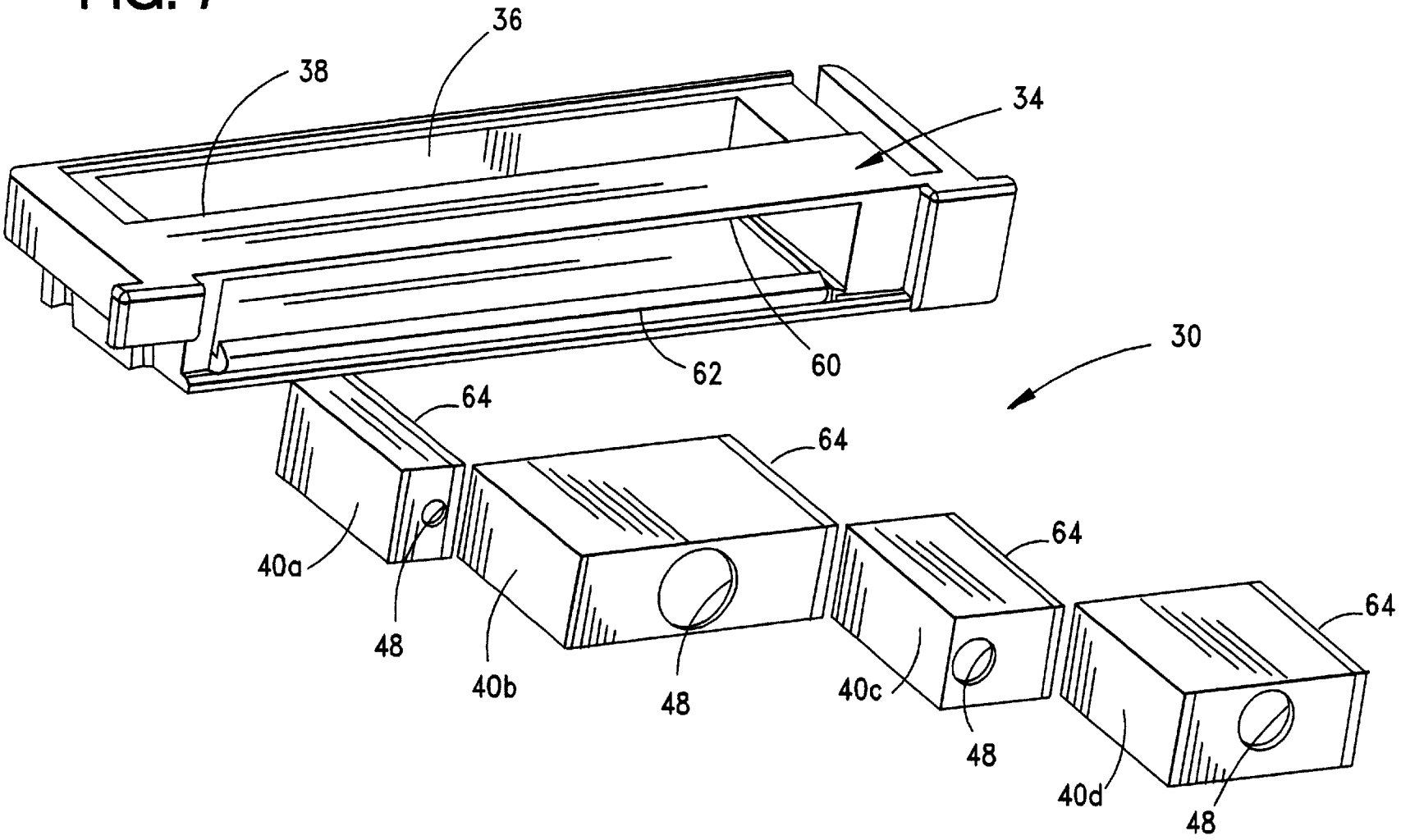
FIG. 7 is a perspective view of the housing of FIG. 6, with the terminal blocks having been removed therefrom.

FIGS. 6 and 7 show an alternative embodiment of a connector assembly 30 which includes a dielectric connector housing 34 which mounts a plurality of terminal blocks 40*a*–40*d* in a given array of differently sized terminal blocks. In order to best understand the invention herein, like reference numerals have been applied in FIGS. 6 and 7 corresponding to like components described above in the embodiment of FIGS. 1–5, even though the various sizes of terminal blocks 40*a*–40*d* in FIGS. 6 and 7 may be slightly different from those in FIGS. 1–5.

With that understanding, housing 34 again includes a receptacle 36 for receiving terminal blocks 40*a*–40*d*, with the receptacle having an opening 38 through which planar surfaces 50 of the terminal blocks are exposed for engaging the conductors of the flat flexible circuit. The terminal blocks are inserted through a front opening 60 of the housing into receptacle 36, and an elongated, ramped latching flange 62 holds the terminal blocks in the receptacle as seen in FIG. 6. Again, the terminal blocks have holes 48 for receiving the discrete electrical wires 12*a*–12*d* of different gages, with the blocks crimped onto the wires.

With the embodiment of FIGS. 6 and 7, dielectric separators 64 are fixed to at least one of the terminal blocks in each adjacent pair thereof. In the illustrated embodiment, the dielectric separators comprise flat electrically insulating wafers 64 fixed to a planar side surface of at least one terminal block of each adjacent pair. These dielectric wafers electrically insulate or isolate the terminal blocks from each other.

With dielectric separators 64 being integral with terminal blocks 40*a*–40*d*, and with receptacle 36 in housing 34 being a continuous cavity void of any walls, it can be understood that practically an infinite variety of different arrays of varying sized terminal blocks can be positioned within housing 34 to match any given pattern of laterally spaced conductor strips on a flat circuit.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A system for connecting a plurality of discrete electrical wires to conductors of a flat circuit, wherein the conductors have varying widths in a pattern laterally of the flat circuit, comprising:

a dielectric connector housing having a receptacle with an opening communicating the receptacle to the exterior of the housing;

a plurality of terminal blocks of conductive material positionable in said receptacle, the terminal blocks having varying sizes with corresponding varying planar surfaces exposed at said opening for engaging the conductors of the flat circuit, the blocks being arranged in the receptacle so that they present a pattern of varying sized planar surfaces matching the pattern of varying width conductors; and termination means on the terminal blocks for terminating a plurality of electrical wires thereto.

2. The system of claim 1 wherein said terminal blocks are generally rectangular in cross-section.

3. The system of claim 1, including retaining means on the connector housing to hold the terminal blocks in the receptacle.

4. The system of claim 1 wherein said termination means comprise holes in the terminal blocks for insertion of the electrical wires thereinto.

5. The system of claim 4 wherein the terminal blocks are deformed to clamp the wires in the holes.

6. The system of claim 4 wherein said holes in the terminal blocks are variably sized in direct proportion to the varying sizes of the terminal blocks.

7. The system of claim 1, including a dielectric separator between each adjacent pair of terminal blocks in the receptacle.

8. The system of claim 7 wherein said dielectric separator is fixed to at least one of the terminal blocks in each adjacent pair thereof.

9. The system of claim 8 wherein said dielectric separator comprises a flat wafer fixed to a planar side surface of the at least one terminal block.

10. The system of claim 7 wherein said dielectric separator is on the dielectric connector housing.

11. The system of claim 10 wherein said dielectric separator comprises a wall molded integrally with the connector housing.

12. The system of claim 11, including a plurality of said walls disposed at regular intervals along the receptacle, the walls being severable from the housing to accommodate terminal blocks of varying sizes in varying arrays between the walls.

13. A connector assembly for interconnection to conductors of a flat circuit, wherein the conductors are in a pattern of varying widths, comprising:

a dielectric housing having a receptacle with an opening communicating the receptacle to the exterior of the housing; and a plurality of terminal blocks of conductive material positionable in a side-by-side array in the receptacle, the terminal blocks having varying sizes with corresponding varying planar surfaces exposed at said opening for engaging the conductors of the flat circuit, the blocks being arranged in the receptacle so that they present a pattern of varying sized planar surfaces matching the pattern of varying width conductors.

14. The connector assembly of claim 13 wherein said terminal blocks are generally rectangular in cross-section.

15. The connector assembly of claim 13, including retaining means on the housing to hold the terminal blocks in the receptacle.

16. The connector assembly of claim 13, including a dielectric separator between each adjacent pair of terminal blocks in the receptacle.

17. The connector assembly of claim 16 wherein said dielectric separator is fixed to at least one of the terminal blocks in each adjacent pair thereof.

18. The connector assembly of claim 16 wherein said dielectric separator comprises a flat wafer fixed to a planar side surface of the at least one terminal block.

19. The connector assembly of claim 16 wherein said dielectric separator is on the dielectric connector housing.

20. The connector assembly of claim 19 wherein said dielectric separator comprises a wall molded integrally with the connector housing.

21. The connector assembly of claim 20, including a plurality of said walls disposed at regular intervals along the receptacle, the walls being severable from the housing to accommodate terminal blocks of varying sizes in varying arrays between the walls.

* * * * *